US007253812B2

(12) United States Patent
Sasaki

(10) Patent No.: US 7,253,812 B2
(45) Date of Patent: Aug. 7, 2007

(54) EL DISPLAY DRIVER AND EL DISPLAY

(75) Inventor: Toru Sasaki, Osaka (JP)

(73) Assignee: Sanyo Electric Co., Ltd., Osaka (JP)

( * ) Notice: Subject to any disclaimer, the term of this patent is extended or adjusted under 35 U.S.C. 154(b) by 550 days.

(21) Appl. No.: 10/772,288

(22) Filed: Feb. 6, 2004

(65) Prior Publication Data

US 2004/0155843 A1 Aug. 12, 2004

(30) Foreign Application Priority Data

Feb. 12, 2003 (JP) ..... 2003-034209
Feb. 13, 2003 (JP) ..... 2003-035626
Feb. 13, 2003 (JP) ..... 2003-035627

(51) Int. Cl.
*G09G 3/30* (2006.01)

(52) U.S. Cl. ..... 345/204; 345/30; 345/36; 345/76; 345/214; 315/169.3; 315/291

(58) Field of Classification Search ..... 345/36, 345/55, 77, 204, 205, 214, 76; 315/169.3, 315/291
See application file for complete search history.

(56) References Cited

U.S. PATENT DOCUMENTS 6,246,180 B1 * 6/2001 Nishigaki ..... 315/169.3
6,351,076 B1 * 2/2002 Yoshida et al. ..... 315/169.1
7,023,141 B2 * 4/2006 Anzai et al. ..... 315/169.3
2002/0190664 A1 * 12/2002 Tanaka et al. ..... 315/169.3
2004/0095299 A1 * 5/2004 Matsumoto ..... 345/76
2004/0113872 A1 * 6/2004 Nanno et al. ..... 345/76

FOREIGN PATENT DOCUMENTS

JP 2000-221942 8/2000
JP 2002-040963 A1 2/2002
JP 2004-046218 2/2004

* cited by examiner

*Primary Examiner*—Bipin Shalwala
*Assistant Examiner*—Vincent E. Kovalick
(74) *Attorney, Agent, or Firm*—Westerman, Hattori, Daniels & Adrian, LLP.

(57) ABSTRACT

A pulse having a width of 20H is inserted into STV in correspondence with a vertical blanking period (a period of 21 H), and the speed of CKV is increased to 12 times the original speed over the period of 21 H at the same time the pulse becomes High. A video signal in the vertical blanking period is at a black level, so that black is written into all organic EL elements in the period. An organic EL display continues to display black for a time period elapsed until a video is next written by the original line selection pulse. The video signal is corrected such that the shorter a video display time period provided to the EL element becomes, the higher the input video luminance of the EL element becomes in order to display black.

7 Claims, 9 Drawing Sheets

(a)

(b)

(a)

(b)

EL DISPLAY DRIVER AND EL DISPLAY

BACKGROUND OF THE INVENTION

Field of the Invention

The present invention relates to a driver that drives a display composed of EL (Electroluminescence) elements on the basis of a video signal and an EL display.

An organic EL element has a structure in which an ITO (Indium Tin Oxide) transparent anode 52, a hole transporting layer 53, an organic light emitting layer 54, an electron transporting layer 55, and a cathode 56 are laminated in this order on a glass board 51, as shown in FIG. 8, for example. When electrons and holes are respectively supplied from the cathode 56 and the anode 52 by a power supply 57, the electrons and the holes are recombined in the organic light emitting layer 54 so that organic molecules enter an excited state. When an attempt to return to the original state (normal state) is made, light is emitted from the organic light emitting layer 54. The whole of energy in a case where the electrons and the holes are recombined is not emitted as light outward, but a part of the energy is changed into heat to raise the temperature of the organic EL element. When the temperature of the organic EL element is raised, the mobility of the electrons and the holes are reduced so that the luminance of the organic EL element is lowered.

An organic EL display utilizing the organic EL element can be roughly classified into a passive matrix driving type and an active matrix driving type, similarly to an LCD (Liquid Crystal Display). The passive matrix driving type has a simple matrix configuration in which a portion where an anode and a cathode cross each other can emit light, and lights up only at the time of selecting a vertical line. On the other hand, the active matrix driving type is configured by arranging a TFT (Thin Film Transistor) 31 for switching in each of organic EL elements 30 and such that into the organic EL element 30 selected by a horizontal (H) shift register 21 for selecting pixels (rows) and a vertical (V) shift register 22 for selecting lines (columns), a video signal at that time is written, and a video signal component (a voltage) is held by a capacitor C mounted on each of the organic EL elements 30 so that the organic EL element 30 lights up for a predetermined time period, as shown in FIG. 9 (see JP-A-2002-40963).

Here, suppose a case where a video based on NTSC (National Television System Committee) (hereinafter referred to as an NTSC video) is displayed on an organic EL display composed of 320 horizontal pixels and 240 vertical pixels. In this case, STV (a vertical start signal) is inputted to the vertical shift register 22 such that the uppermost (top) line in the display is selected at the timing of a pulse CKV in a horizontal frequency (a vertical control clock) corresponding to a line number 22 and a line number 285, as shown in FIG. 10. When an effective video period is set to 80% of the horizontal period, a pulse CKH (a horizontal control clock) which is 320/0.8=400 times the horizontal frequency is inputted, as shown in FIG. 11, to the horizontal shift register 21, and STH (a horizontal start signal) is inputted thereto such that the leftmost pixel on each of the lines in the display is selected immediately after the effective video period is started. CSV (switching in a vertical shifting direction) and CSH (switching in a horizontal shifting direction) in FIG. 9 are signals for respectively determining the directions of shifting of the vertical shift register 22 and the horizontal shift register 21, and are not generally operated after the arrangement of the display is determined.

When an image with a white lattice pattern on a black background, for example, continues to be displayed for a while on the organic EL display driven in the above-mentioned manner, the organic EL element displayed in black does not receive energy at all so that the temperature thereof is not raised, while the organic EL element displayed in white continues to always receive energy so that the temperature thereof continues to be raised to lower the luminance thereof because a part of the received energy is changed into heat. In this state, the image is normal. When an attempt to display, after the image is displayed, a solid gray image, for example, is made, however, the organic EL element whose temperature is raised is lower in the luminance, as compared with the organic EL element whose temperature is not raised, so that a black lattice pattern on a white background looks slight.

SUMMARY OF THE INVENTION

In view of the foregoing circumstances, an object of the present invention is to provide an EL display driver that can restrain the rise in the temperature of each of EL elements to reduce the nonuniformity in the temperature among the EL elements and therefore, can reduce the nonuniformity in luminance on a screen of a display composed of the EL elements, and an EL display.

In order to solve the above-mentioned problem, in a driver that drives a display composed of EL elements on the basis of a video signal, an EL display driver according to the present invention is characterized by comprising means for forming a non-luminescent state in all the EL elements utilizing a vertical blanking period of the video signal, and correction means for correcting the luminance of the video signal such that the shorter a video display time period provided to the EL element becomes, the higher the input video luminance of the EL element becomes in order to form the non-luminescent state.

In the above-mentioned configuration, the non-luminescent state is formed in all the EL elements utilizing the vertical blanking period, so that a cooling period is provided to all the EL elements. Consequently, the rise in the temperature of each of the EL elements is restrained, and the nonuniformity in the temperature among the EL elements is reduced so that the nonuniformity in luminance on a screen of the display is reduced. The change in the display luminance among display areas on the display, which occurs because the video display time periods provided to the EL elements differ by forming the non-luminescent state, is solved by the correction means.

The correction means may be composed of an A/D converter for converting the video signal into a digital video, and an operating unit for executing operation processing for correcting the luminance of the digital video.

The correction means may be composed of a variable gain amplifier receiving the video signal for amplifying the video signal with an arbitrary gain and outputting the amplified video signal, and the variable gain amplifier may change the gain on the basis of a vertical synchronizing signal in the video signal.

In an EL display that drives EL elements on the basis of a video signal, an EL display according to the present invention is characterized by comprising a switch for discharging charges in a capacitor provided in each of pixels composed of the EL elements and displaying each of the pixels in black, and control means for turning the switch on at timing a predetermined time period prior to the subsequent video writing into the pixel.

In the above-mentioned configuration, a non-luminescent state (a black display state) for a predetermined time period can be formed in each of the EL elements by operating the switch for black display. Accordingly, a cooling period is provided to all the EL elements. Consequently, the rise in the temperature of each of the EL elements is restrained, and the nonuniformity in the temperature among the EL elements is reduced so that the nonuniformity in luminance on a screen of the display is reduced. Since the non-luminescent state is formed a predetermined time period prior to the subsequent video writing into each of the pixels, a predetermined cooling period and a predetermined video display time period are provided in any area on the display.

The EL display having the above-mentioned configuration may be so configured that there is provided a vertical shift register for black display, and a black writing start signal is inputted to the vertical shift register for black display at predetermined timing.

In a driver that drives a display composed of EL elements on the basis of a video signal, an EL display driver according to the present invention is characterized by comprising means for forming a non-luminescent state in all the EL elements utilizing a vertical blanking period of the video signal, an analog-to-digital (A/D) converter for converting the video signal into video data, means for writing the video data into a memory, means for reading out the video data from the memory such that the direction of video supply in a one-field video is reversed for each field, and means for reversing the direction of video writing into the display for each field in correspondence with the reversal of the direction of video supply for each field.

In the above-mentioned configuration, the non-luminescent state is formed in all the EL elements utilizing the vertical blanking period, so that a cooling period is provided to all the EL elements (the cooling period provided to each of the EL elements differs on the upper and lower sides of the display from the viewpoint of one field period). Consequently, the rise in the temperature of each of the EL elements is restrained, and the nonuniformity in the temperature among the EL elements is reduced so that the nonuniformity in luminance on a screen of the display is reduced. The direction of video supply and the direction of video writing are respectively reversed for each field, thereby making it possible to make the cooling period and the video display time period of each of the EL elements uniform on the upper and lower sides of the display from the viewpoint of one frame period.

The direction of video supply and the direction of video writing may be respectively reversed in units of lines in the one-field video.

The direction of video supply and the direction of video writing may be respectively reversed in units of pixels in the one-field video.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiment 1

Figure 1:
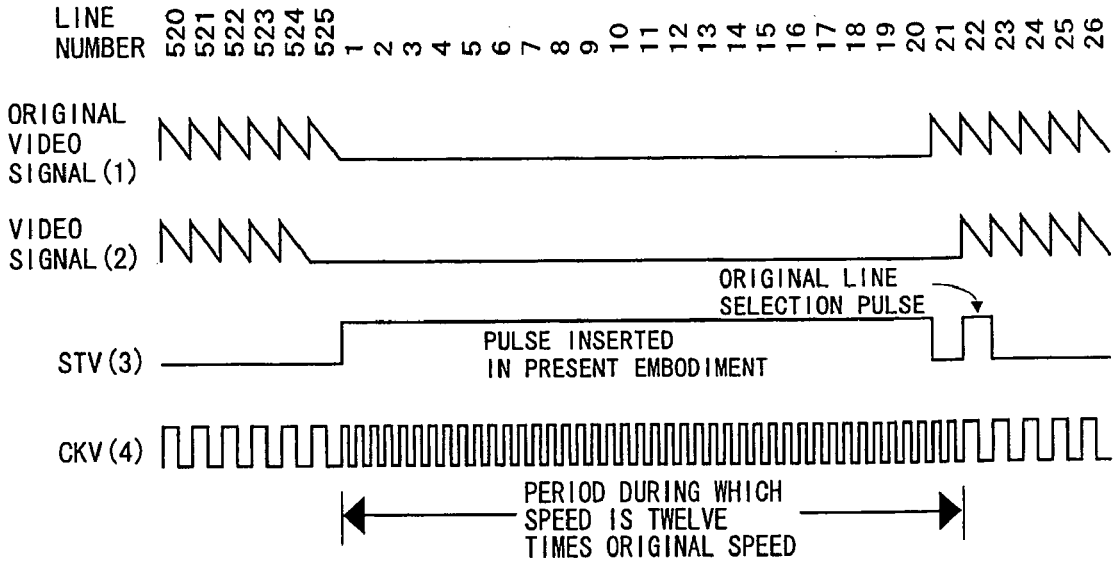
FIG. 1, consisting of FIGS. 1(*a*) and 1(*b*), are explanatory views related to an EL display driver according to the present invention, where the waveform of each of signals to an EL display is illustrated.
Figure 1:
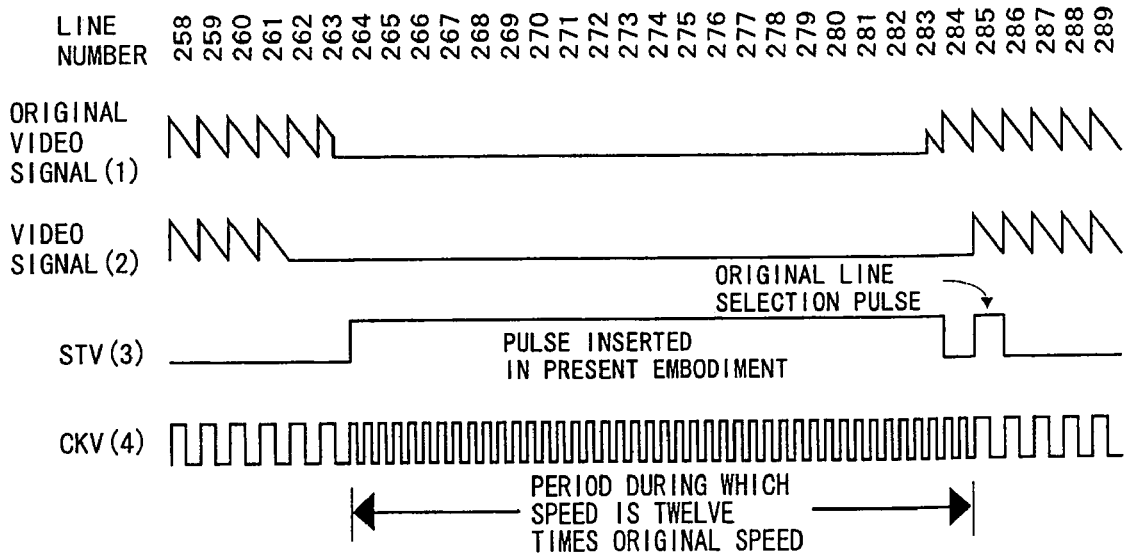
Figure 9:
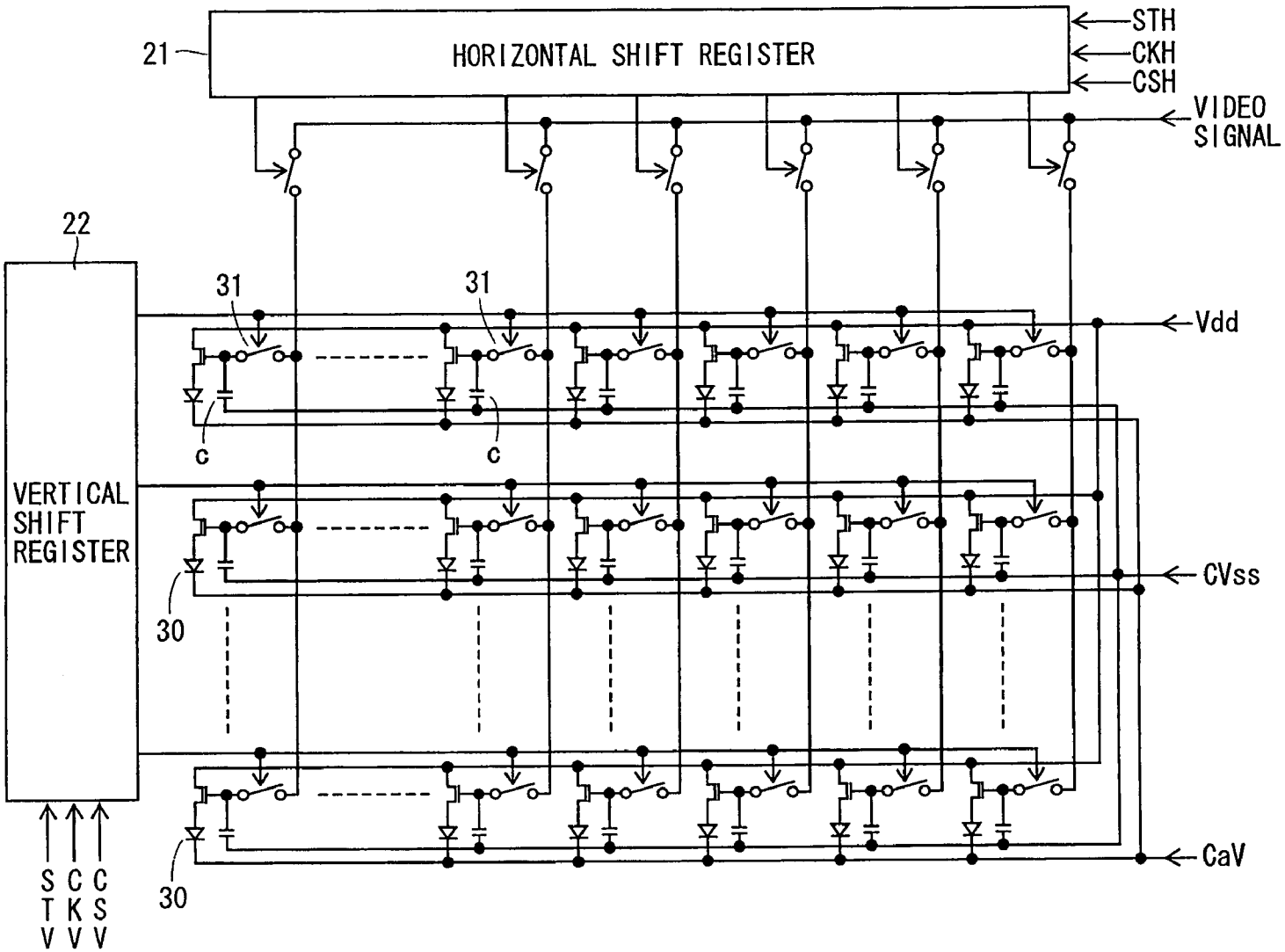
FIG. 9 is a circuit diagram showing a general active driving type organic EL display.
Figure 10:
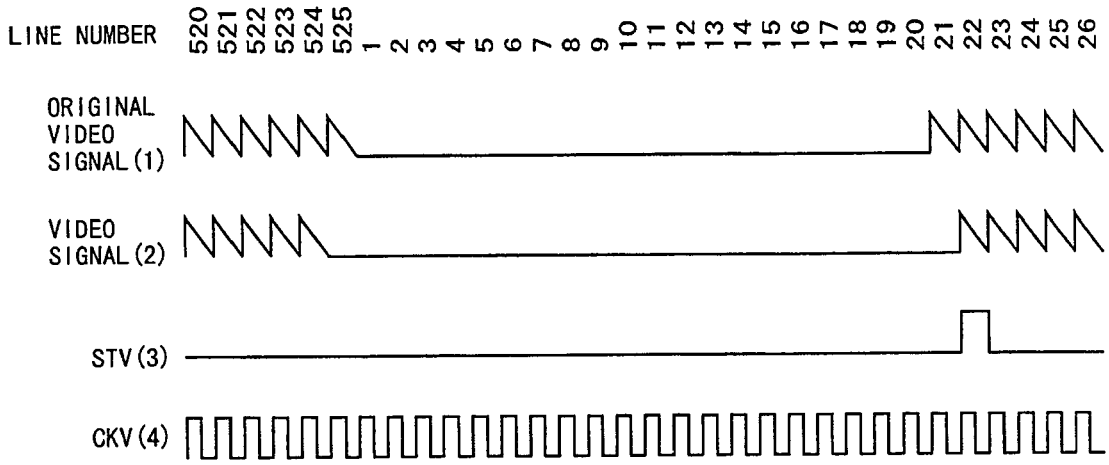
FIG. 10, consisting of FIGS. 10(*a*) and 10(*b*), are explanatory views showing the waveform of each of driving signals to an organic EL display in a conventional driver.
Figure 10:
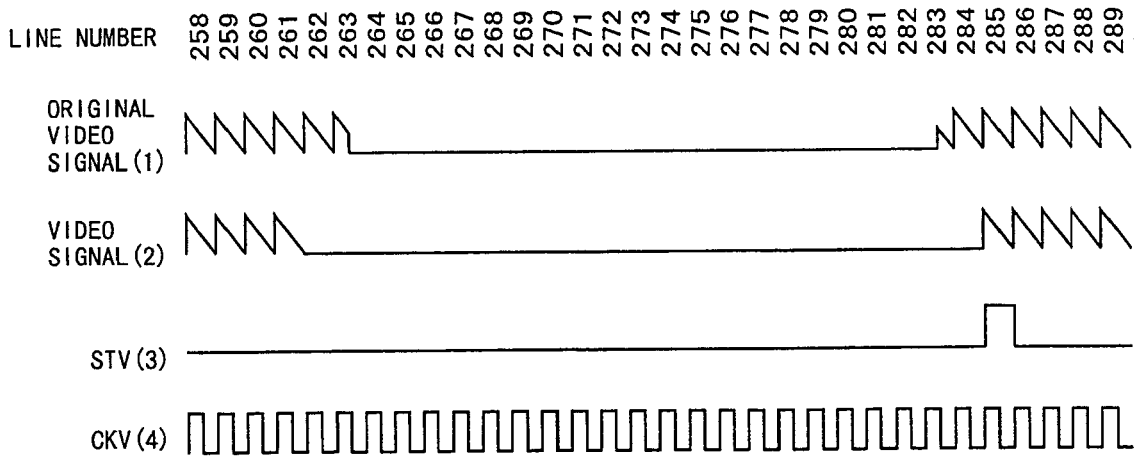
Figure 11:
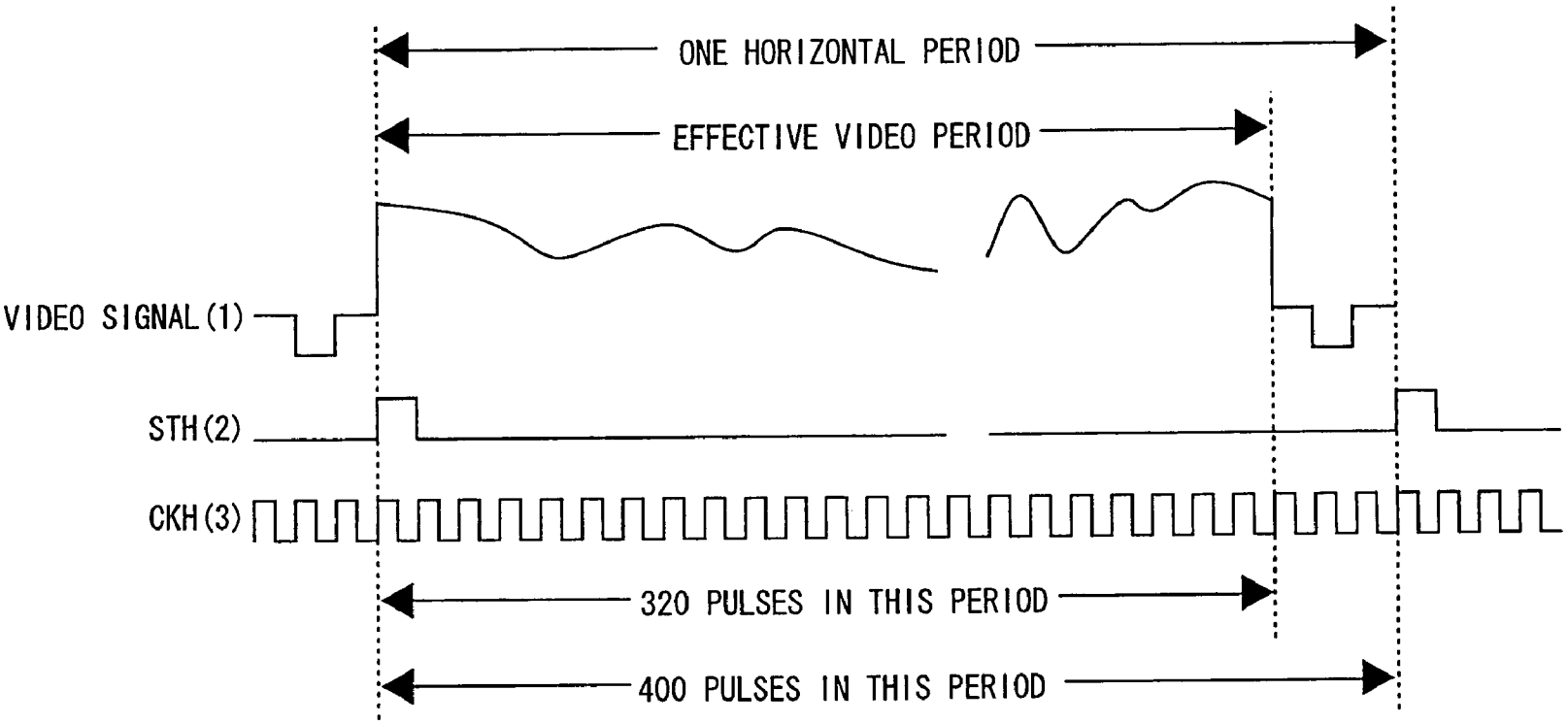
FIG. 11 is a reference view and an explanatory view showing the relationship between a video signal and driving signals in one horizontal period fed to an organic EL display.

An EL display driver according to an embodiment of the present invention will be described on the basis of FIGS. 1 and 2. An organic EL display to be a driving object of the driver according to the present embodiment shall have the same configuration as that shown in FIG. 9.

Figure 2:
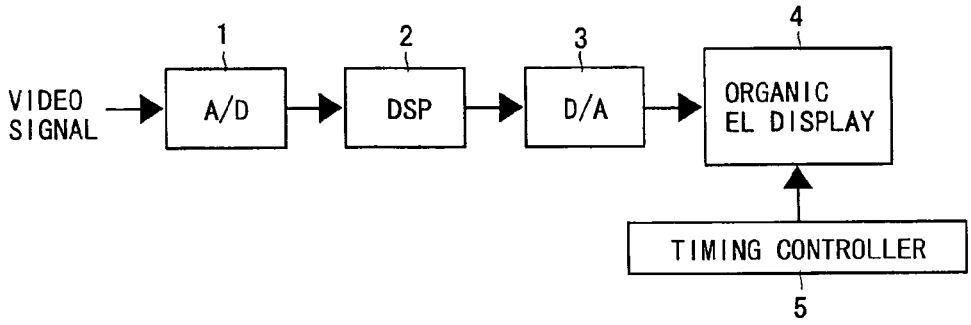
FIG. 2 is a block diagram showing a driver composed of a digital circuit.

As illustrated in FIG. 2, the driver according to the present embodiment comprises an analog-to-digital (A/D) converter 1 receiving a video signal (an NTSC video signal in the present embodiment) for producing digital video data, a digital signal processor (DSP) 2 for subjecting the digital video data to correction processing, a digital-to-analog (D/A) converter 3 for changing the digital video data which has been subjected to the correction processing into an analog video signal, an organic EL display 4, and a timing controller 5.

The timing controller 5 carries out output control of STV and CKV of a vertical shift register 22 (see FIG. 9) in the organic EL display 4. The timing controller 5 inserts a pulse having a width of 20 H into the STV in correspondence with a vertical blanking period (a period of 21 H), and increases the speed of the CKV to 12 times the original speed over the period of 21 H (21 H×12=252) at the same time the pulse becomes High. A video signal in the vertical blanking period is at a black level, so that black is written into all the organic EL elements in this period. Accordingly, the organic EL display 4 continues to display black for a time period elapsed until a video is next written by the original line selection pulse (STV). That is, all the organic EL elements do not receive energy at all in the vertical blanking period, so that the temperature of each of the organic EL elements is lowered. The rise in the temperature of the EL element can be restrained, as compared with that in a case where the organic EL display 4 continues to display white, thereby making it possible to reduce the nonuniformity in the luminance thereof due to the decrease in the luminance.

In the above-mentioned control, however, a time period during which the uppermost line displays a video in one frame period is 483/525 (21 H×2 (field)=42 is subtracted from 525, to obtain 483), and a time period during which the lowermost (bottom) line displays a video is 44/525 ((21 H+1 (its own period))×2 (field)=44). That is, the luminance of an image decreases toward the lower side of a screen.

The digital signal processor (DSP) 2 corrects a video signal inputted to the organic EL display 4 in its input stage to make the luminance uniform in order to solve the decrease in the luminance toward the lower side of the screen. Specifically, letting k be a correction factor, each of the lines is multiplied by the reciprocal of the degree of decrease in luminance such that a video signal written into the uppermost line is multiplied by k×525/483 (≈k×1), and a video signal written into the lowermost line is multiplied by k×525/44 (≈k×12), to correct the luminance of the video signal to a proper luminance. Further, a video signal corresponding to the intermediate line is so corrected that it is multiplied by about k×6.

Embodiment 2

Figure 3:
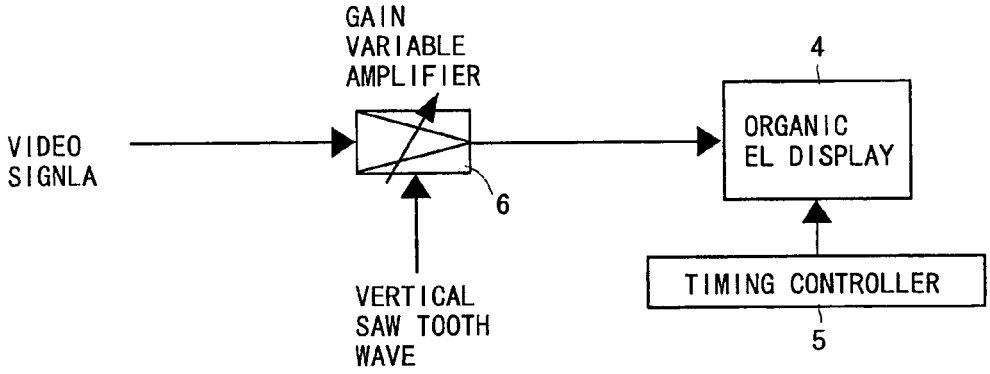
FIG. 3 is a block diagram showing a driver composed of an analog circuit.

Another embodiment of the present invention will be described on the basis of FIG. 3. A circuit shown in FIG. 3 is an example of an analog circuit for passing a video signal through a gain variable amplifier 6 and controlling the gain of the gain variable amplifier 6 using a vertical saw tooth wave. That is, the frequency of the vertical saw tooth wave corresponds to a pixel data writing period in an organic EL display 4, and the change in the voltage value of the vertical saw tooth wave and a pixel position (the degree of decrease in luminance) of each of organic EL elements composing the organic EL display 4 correspond to each other. Accordingly, the gain of the gain variable amplifier 6 is adjusted by the vertical saw tooth wave. Consequently, the shorter a video display time period provided to the organic EL element becomes, the higher the input video luminance of the organic EL element becomes, thereby making it possible to solve the change in display luminance among display areas on the organic EL display 4.

Although in the above-mentioned embodiment, a case where an NTSC video is displayed on an organic EL display composed of 320 horizontal pixels and 240 vertical pixels was illustrated, the present invention is not limited to such numbers of pixels. Further, the present invention is not limited to the display of the NTSC video.

As described in the foregoing, according to the present invention, the non-luminescent state is formed in all the EL elements utilizing a vertical blanking period, so that a cooling period is provided to all the EL elements, thereby producing the effect of restraining the rise in the temperature of each of the EL elements, and reducing the nonuniformity in the temperature among the EL elements to reduce the nonuniformity in luminance on a screen of the display.

Embodiment 3

An organic EL display according to an embodiment of the present invention will be described on the basis of FIGS. 4 and 5.

Figure 4:
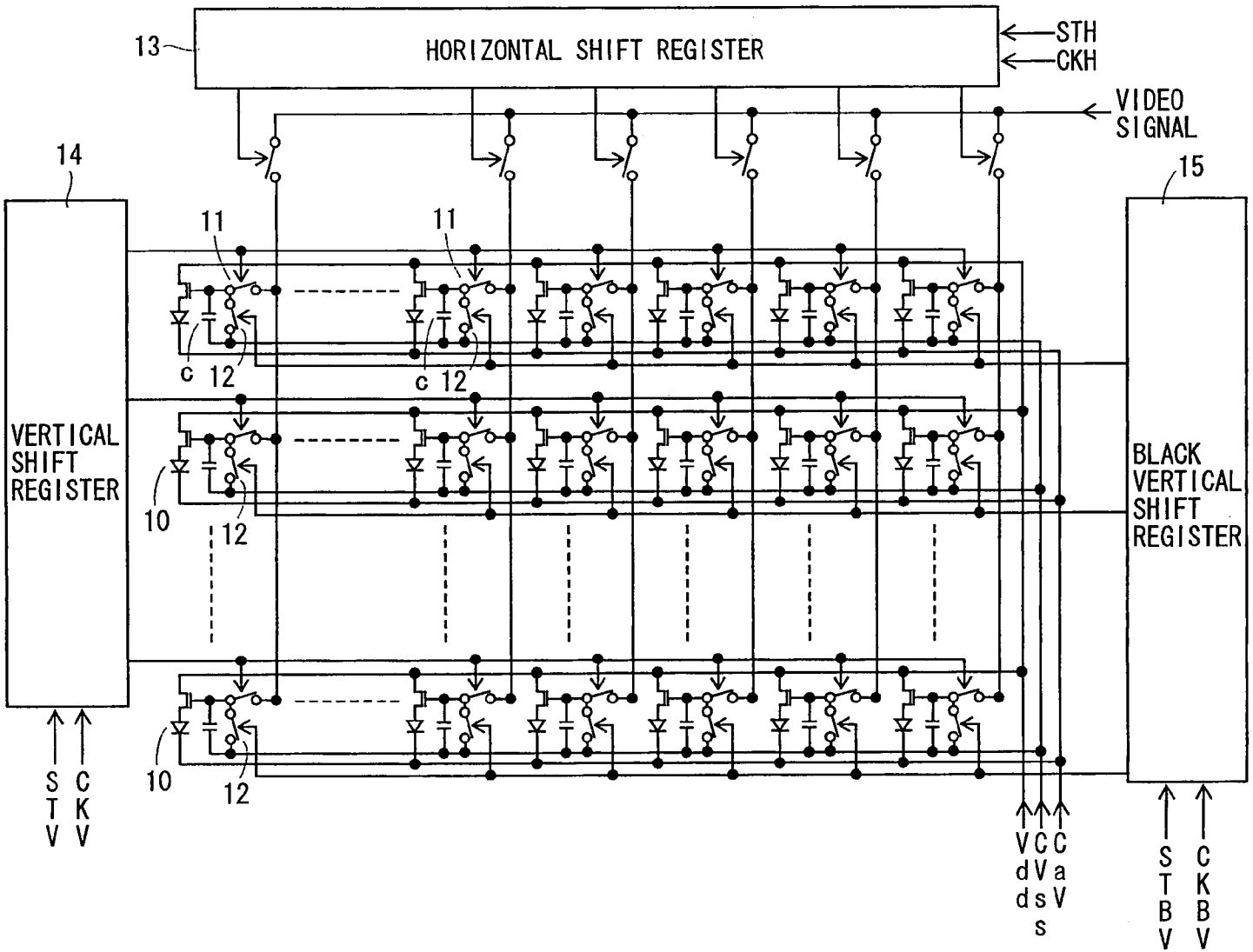
FIG. 4 is a circuit diagram showing an organic EL display according to the present invention.

FIG. 4 is a circuit diagram showing an organic EL display according to the present embodiment. The organic EL display is configured by arranging a TFT 11 for switching in each of organic EL elements 10 and such that into the organic EL element 10 selected by a horizontal (H) shift register 13 for selecting pixels (rows) and a vertical (V) shift register 14 for selecting lines (columns), a video signal at that time is written, and a video signal component (a voltage) is held by a capacitor C mounted on each of the organic EL elements 10 so that the organic EL element 10 lights up for a predetermined time period. The present invention is characterized in that a black display switch 12 is connected in parallel with the capacitor C in each of the pixels, and the black display switch 12 is subjected to ON/OFF control by a black vertical shift register 15.

CKH (a horizontal control clock) and STH (a horizontal start signal) are fed to the horizontal shift register 13 from a timing controller (not shown), CKV (a vertical control clock) and STV (a vertical start signal) are fed to the vertical shift register 14, and CKBV (a vertical black control clock) and STBV (a vertical black start signal) are fed to the black vertical shift register 15.

Here, suppose a case where an NTSC video is displayed on an organic EL display composed of 320 horizontal pixels and 240 vertical pixels. In this case, the STV is inputted to the vertical shift register 14 such that the uppermost line in the display is selected at the timing of the pulse CKV in a horizontal frequency corresponding to a line number 22 and a line number 285, as shown in FIGS. 5(*a*) and 5(*b*), by the control of the timing controller. When an effective video period is set to 80% of the horizontal period, the pulse CKH which is 320/0.8=400 times the horizontal frequency is inputted to the horizontal shift register 13, and the STH is inputted thereto such that the leftmost pixel on each of the lines in the display is selected immediately after the effective video period is started.

Figure 5:
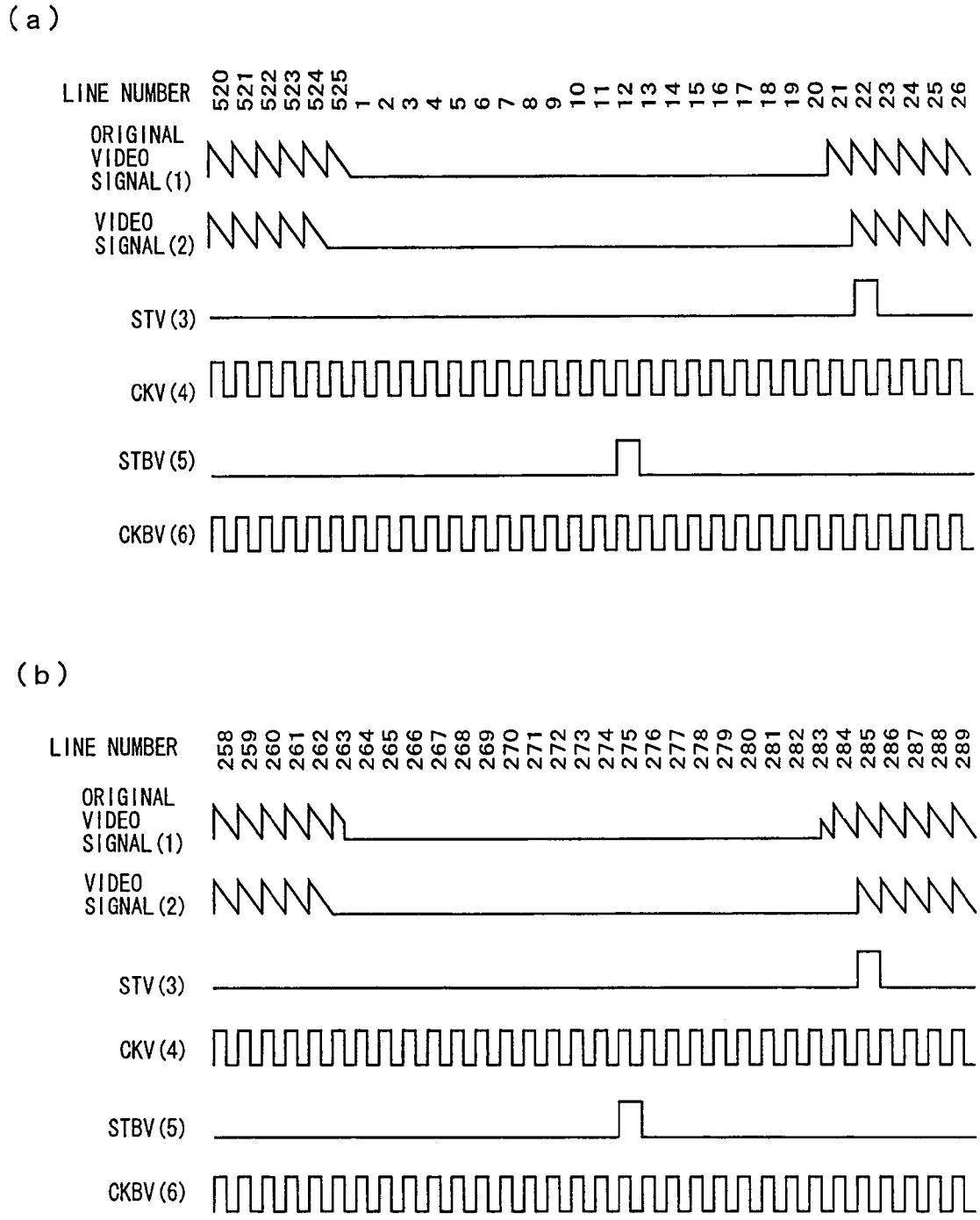
FIG. 5, consisting of FIGS. 5(*a*) and 5(*b*), are explanatory views showing the waveform of each of signals to the EL display shown in FIG. 4.

Furthermore, the timing controller feeds the STBV to the black vertical shift register 15 at the timing shown in FIG. 5. In the example shown in FIG. 5, the STBV which is a black writing selection pulse is fed to the black vertical shift register 15 a period of 10 H prior to the time point where a video is written by the STV which is the original video writing selection pulse. When the STBV is fed to the black vertical shift register 15, a black writing line is selected for each 1 H. On the selected black writing line, the black display switch 12 is tuned on, so that charges in the capacitor C connected thereto are discharged, thereby entering a non-luminescent state (a black display state). On the line displayed in black, the subsequent video is written after an elapse of a period of 10 H.

Black display for a period of 10 H in one field is thus performed in each of the pixels. In the period of 10 H, the organic EL element 10 does not receive energy at all, so that the temperature thereof is lowered. Accordingly, the rise in the temperature of the organic EL, element 10 can be restrained, as compared with that in a case where white display continues to be performed, thereby making it possible to reduce the nonuniformity in the luminance thereof due to the decrease in the luminance. In the black display for the period of 10 H as illustrated, the luminance of the whole of the organic EL display is 505/525≈96.2% of that in a case where the black display is not performed, so that the decrease in the luminance is hardly concerned about.

Although in the above-mentioned embodiment, a case where an NTSC video is displayed on the organic EL display composed of 320 horizontal pixels and 240 vertical pixels was illustrated, the present invention is not limited to such numbers of pixels. Further, the present invention is not limited to the display of the NTSC video. Although in the above-mentioned example, the black display for the period of 10 H is performed, the present invention is not limited to such a period. As described in the foregoing, the non-luminescent state is formed in all the EL elements for a predetermined time period, so that a cooling period is provided to all the EL elements, thereby producing the effect of restraining the rise in the temperature of each of the EL elements, and reducing the nonuniformity in the temperature among the EL elements to reduce the nonuniformity in luminance on a screen of the display.

Embodiment 4

Figure 6:
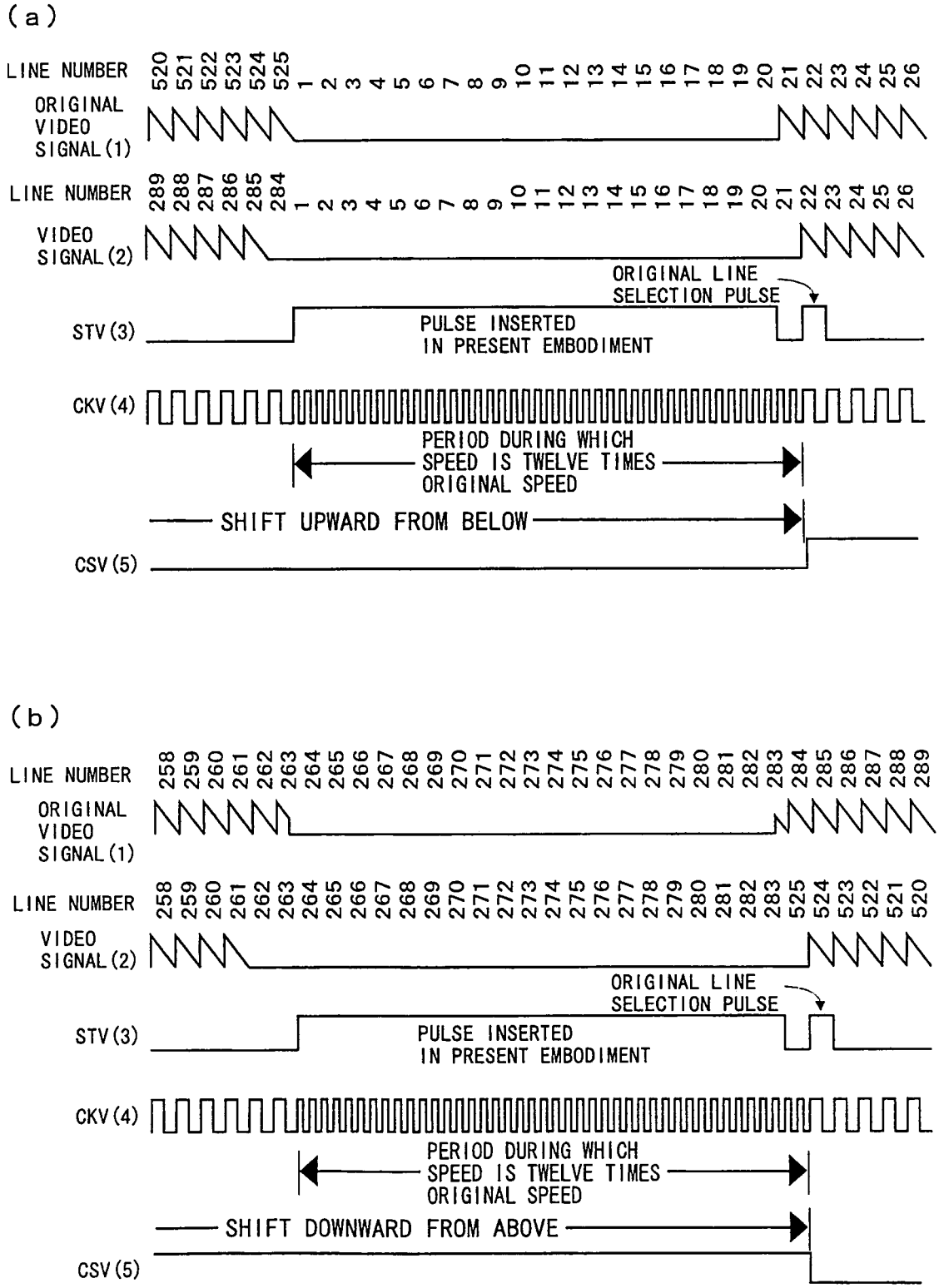
FIG. 6, consisting of FIGS. 6(*a*) and 6(*b*), are explanatory views related to an EL display driver according to the present invention, where the waveform of each of signals to an EL display is illustrated.

An EL display driver according to an embodiment of the present invention will be described on the basis of FIGS. 6 and 7. An organic EL display to be a driving object of the driver according to the present embodiment shall have the same configuration as that shown in FIG. 9.

Figure 7:
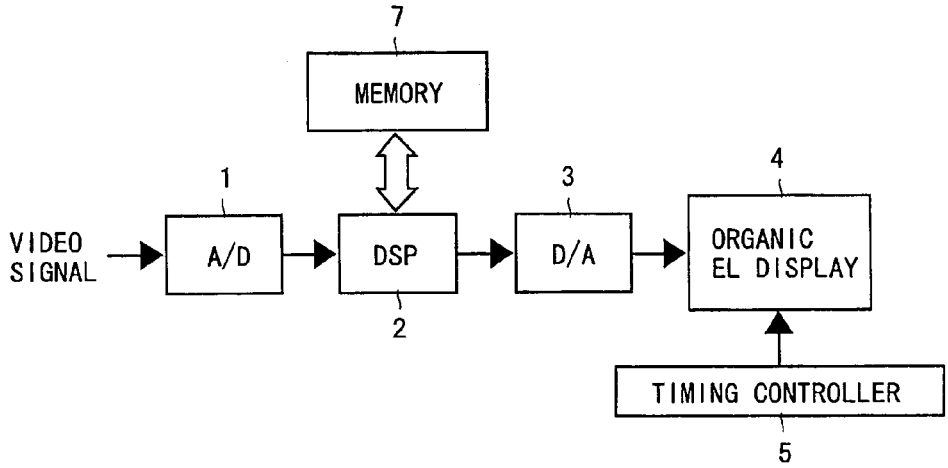
FIG. 7 is a block diagram showing an organic EL display driver according to the present invention.
Figure 8:
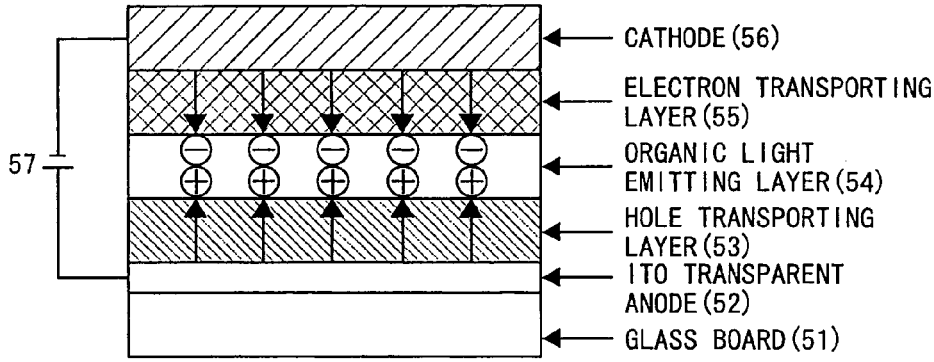
FIG. 8 is a cross-sectional view showing a general organic EL element.

As illustrated in FIG. 7, the driver according to the present embodiment comprises an A/D converter 1 receiving a video signal (an NTSC video signal in the present embodiment) for producing digital video data, a digital signal processor (DSP) 2 for performing processing such as processing for writing the digital video data into a memory 7 as well as reading out the video data written into the memory 7, a D/A converter 3 for changing the digital video data outputted from the digital signal processor 2 into an analog video signal, an organic EL display 4, and a timing controller 5.

The timing controller 5 carries out output control of STV (a vertical start signal), CKV (a vertical control clock), and CSV (switching in a vertical shifting direction) of a vertical shift register 22 (see FIG. 9) in the organic EL display 4. The timing controller 5 inserts a pulse having a width of 20 H into the STV in correspondence with a vertical blanking period (a period of 21 H), and increases the speed of the CKV to 12 times the original speed over the period of 21 H (21 H×12=252) at the same time the pulse becomes High, as shown in FIGS. 6(*a*) and 6(*b*). The video signal in the vertical blanking period is at a black level. Accordingly, black is written into all the organic EL elements in this period, and the organic EL display 4 continues to display black for a time period elapsed until a video is next written by the original line selection pulse. That is, each of the organic EL elements does not receive energy at all in the vertical blanking period, so that the temperature thereof is lowered. Accordingly, the rise in the temperature of the organic EL element can be restrained, as compared with that in a case where the organic EL display 4 continues to display white, thereby reducing the nonuniformity in the luminance thereof due to the decrease in the luminance.

If it is herein assumed that the direction of video supply and the direction of video writing in a one-field video to the organic EL display 4 are the same in an even-numbered field and an odd-numbered field, a time period during which the uppermost line indicates a video signal in one frame period is 483/525 (21 H×2 (field)=42 is subtracted from 525, to obtain 483), and a time period during which the lowermost line indicates a video signal is 44/525 ((21 H+1 (its own period))×2 (field)=44). That is, the luminance of an image decreases toward the lower side of a screen.

Therefore, such control as to prevent the difference in luminance from occurring in a screen area by the processing of the digital signal processor 2 and the timing controller 5 is carried out. The digital signal processor 2 reads out video data corresponding to one field stored in the memory 7 in descending order from the uppermost line when the field is an odd-numbered field, while reading out the video data in ascending order from the lowermost line when the field is an even-numbered field, for example. The timing controller 5 carries out such control as to make the CSV fed to the vertical shift register 22 High (shifting downward from top) when the field is an odd-numbered field, while making the CSV Low (shifting upward from below) when the field is an even-numbered field.

Consequently, a video in an odd-numbered field is written into the organic EL display 4 in the above-mentioned order (downward from top), and black is written thereinto downward from above at a speed which is 12 times the original speed over a period of 21 H in the subsequent vertical blanking period. At this time, alighting time period on the uppermost line is 261/262.5, while a lighting time period on the lowermost line is about 22/262.5. In the subsequent even-numbered field, a video on the memory is read out in reverse order from the lower line to the upper line, the video read out in reverse order from the lower line to the upper line is written into the organic EL display 4, and black is written thereinto upward from below at a speed which is 12 times the original speed over a period of 21 H in the subsequent vertical blanking period. At this time, a lighting time period on the uppermost line is about 22/262.5, while a lighting time period on the lowermost line is 261/262.5. Consequently, a lighting time period in one frame period is 283/525 which is the same on any line. There is no change in luminance among the areas of the organic EL display 4.

Although in the above-mentioned embodiment, the direction of video supply and the direction of video writing are respectively reversed in units of lines in a one-field video, the present invention is not limited to the same. For example, the direction of video supply and the direction of video writing may be respectively reversed in units of pixels in a one-field video. In this case, the digital signal processor 2 generates a read address for the memory 7 such that with respect to data representing pixels composing each of the lines, the pixels are read out forward from the back on the line when video data to be read out corresponds to an even-numbered field. Further, the timing controller 5 carries out such control that the CSH fed to the horizontal shift register 21 is made High (shifted rightward from the left) when video data to be written corresponds to an even-numbered field. Although in the above-mentioned embodiment, a case where an NTSC video is displayed on the organic EL display composed of 320 horizontal pixels and 240 vertical pixels was illustrated, the present invention is not limited to such numbers of pixels. Further, the present invention is not limited to the display of the NTSC video.

As described in the foregoing, the non-luminescent state is formed in all the EL elements utilizing the vertical period, so that a cooling period is provided to all the EL elements, thereby producing the effect of restraining the rise in the temperature of each of the EL elements, and reducing the nonuniformity in the temperature among the EL elements to reduce the nonuniformity in luminance on a screen of the display.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. In a driver that drives a display composed of EL elements on the basis of a video signal, an EL display driver characterized by comprising:

means for forming a non-luminescent state in all the EL elements utilizing a vertical blanking period of said video signal; and correction means for correcting the luminance of said video signal such that the shorter a video display time period provided to the EL element becomes, the higher the input video luminance of the EL element becomes in order to form said non-luminescent state.

2. The EL display driver according to claim 1, wherein said correction means comprises an analog-to-digital converter for converting said video signal into a digital video, and an operating unit for executing operation processing for correcting the luminance of said digital video.

3. The EL display driver according to claim 1, wherein said correction means is composed of a variable gain amplifier receiving said video signal for amplifying the video signal with an arbitrary gain and outputting the amplified video signal, and said variable gain amplifier changes said gain on the basis of a vertical synchronizing signal in said video signal.

4. In an EL display that drives EL elements on the basis of a video signal, an EL display comprising:

a switch for discharging charges in a capacitor provided in each of pixels composed of said EL elements and displaying each of the pixels in black; and control means for turning said switch on at timing a predetermined time period prior to the subsequent video writing into the pixel and wherein, there is provided a vertical shift register for black display, and a black writing start signal is inputted to the vertical shift register for black display at predetermined timing.

5. In a driver that drives a display composed of EL elements on the basis of a video signal, an EL display driver comprising:

means for forming a non-luminescent state in all the EL elements utilizing a vertical blanking period of said video signal;

an analog-to-digital converter for converting said video signal into video data, means for writing said video data into a memory;

means for reading out the video data from said memory such that the direction of video supply in a one-field video is reversed for each field; and means for reversing the direction of video writing into said display for each field in correspondence with the reversal of said direction of video supply for each field.

6. The EL display driver according to claim 5, wherein said direction of video supply and said direction of video writing are respectively reversed in units of lines in the one-field video.

7. The EL display driver according to claim 5, wherein said direction of video supply and said direction of video writing are respectively reversed in units of pixels in the one-field video.

* * * * *